US009953744B2

(12) United States Patent
Aida et al.

(10) Patent No.: US 9,953,744 B2
(45) Date of Patent: Apr. 24, 2018

(54) ELECTRICAL INSULATING PAPER AND STATIONARY INDUCTION ELECTRICAL APPARATUS USING THE SAME

(71) Applicant: Hitachi, Ltd., Chiyoda-ku, Tokyo (JP)

(72) Inventors: Kohhei Aida, Tokyo (JP); Hisashi Morooka, Tokyo (JP); Kenichi Kawamura, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 356 days.

(21) Appl. No.: 14/743,362

(22) Filed: Jun. 18, 2015

(65) Prior Publication Data

US 2015/0371730 A1 Dec. 24, 2015

(30) Foreign Application Priority Data

Jun. 20, 2014 (JP) ..... 2014-127128

(51) Int. Cl.
*H01B 3/52* (2006.01)
*H01F 27/32* (2006.01)
(Continued)

(52) U.S. Cl.
CPC ..... *H01B 3/52* (2013.01); *D21H 11/20* (2013.01); *D21H 19/20* (2013.01); *D21H 21/16* (2013.01);
(Continued)

(58) Field of Classification Search
CPC . H01B 3/52; H01F 27/32; H01F 27/33; H01F 27/245; H01F 27/26; H01F 27/28; H01F 27/263; H01F 27/324; D21H 19/20; D21H 19/22; D21H 19/24; D21H 19/10; D21H 19/80; D21H 21/16; D21H 32/34; D21H 11/16; D21H 11/20; D21H 11/22; D21H 25/02; D21J 1/20
See application file for complete search history.

(56) References Cited

U.S. PATENT DOCUMENTS 2,524,754 A * 10/1950 Bjorklund ..... H01F 27/245 336/210
3,577,109 A * 5/1971 Foster ..... H01F 27/365 336/212
(Continued)

FOREIGN PATENT DOCUMENTS

JP 7-310300 A 11/1995
JP 2003-82598 A 3/2003
JP 2012-219379 A 11/2012

*Primary Examiner* — Scott R Walshon
(74) *Attorney, Agent, or Firm* — Crowell & Moring LLP

(57) ABSTRACT

Electrical insulating paper according to an embodiment of the present invention is used while being immersed in electrical insulating oil, and includes a paper base material mainly containing cellulose, an adsorption layer formed on an entire surface of the paper base material by adsorption, and a moisture barrier layer formed by being chemically bonded to the adsorption layer. The moisture barrier layer includes an amphipathic molecule containing both a hydrophobic hydrocarbon group and a hydrophilic functional group in one molecule. The amphipathic molecule is chemically bonded to the adsorption layer via the hydrophilic functional group. The hydrophobic hydrocarbon group covers the surface of the paper base material.

5 Claims, 3 Drawing Sheets

(51) Int. Cl.

| | |
|---|---|
| ***D21H 21/16*** | (2006.01) |
| ***D21J 1/20*** | (2006.01) |
| ***D21H 19/20*** | (2006.01) |
| ***D21H 11/20*** | (2006.01) |
| ***H01B 3/20*** | (2006.01) |
| *D21H 25/02* | (2006.01) |

(52) U.S. Cl.
CPC ..... *D21J 1/20* (2013.01); *H01B 3/20* (2013.01); *H01F 27/324* (2013.01); *D21H 25/02* (2013.01); *Y10T 428/277* (2015.01); *Y10T 428/31783* (2015.04); *Y10T 428/31993* (2015.04)

(56) References Cited

U.S. PATENT DOCUMENTS

| | | | | |
|---|---|---|---|---|
| 7,749,591 | B2 * | 7/2010 | Fukunaga | B32B 27/10 428/206 |
| 2004/0209023 | A1 * | 10/2004 | Swoboda | B32B 29/06 428/34.2 |

* cited by examiner

ELECTRICAL INSULATING PAPER AND STATIONARY INDUCTION ELECTRICAL APPARATUS USING THE SAME

BACKGROUND OF THE INVENTION

1. Field of the Invention

The present invention relates to electrical insulating paper, and particularly to electrical insulating paper used while being immersed in electrical insulating oil and a stationary induction electrical apparatus using the electrical insulating paper.

2. Description of the Related Art

An oil-immersed transformer is a kind of stationary induction electrical apparatus. In the oil-immersed transformer, an iron core and a winding mounted on the iron core are immersed in electrical insulating oil in a tank, and electrical insulating paper (also simply referred to as insulating paper) is used as an insulating material such as insulating coating of a winding conductor. The insulating paper is a mat-like material having fine pores. It is known that the insulating paper exhibits an excellent insulating property while the pores are impregnated with electrical insulating oil (also simply referred to as insulating oil). The oil-immersed transformer is widely used as, for example, a transformer connected to an electrical system.

The insulating oil is classified according to a main component thereof. Examples of the main component used include mineral oil, alkylbenzene, polybutene, alkylnaphthalene, silicone oil, and ester oil. As the insulating paper, kraft paper, cellulose dielectric paper, chemical-added paper, synthetic fiber paper, or the like is used. Even at present, paper based on kraft paper is mainly used because of total convenience including costs and characteristics. Note that the insulating paper includes a press board here.

It is very important that the transformer connected to a power system have reliability and durability (long-term reliability). The oil-immersed transformer is deteriorated by time-related deterioration of the insulating oil and the insulating paper. Oxygen and water are mainly involved in the deterioration of the insulating oil and the insulating paper.

When the insulating oil is deteriorated, performance of the insulating oil can be recovered by a degassing filtering treatment or exchanging the oil for new oil. When the insulating paper is deteriorated, on the other hand, it is practically very difficult to exchange the insulating paper. Therefore, it is considered that the life of the oil-immersed transformer substantially depends on the deterioration of the insulating paper.

The insulating paper (other than synthetic fiber paper) widely used for the oil-immersed transformer or the like mainly includes cellulose. An average degree of polymerization of cellulose (average number of repetition of a glucose ring in cellulose) is used as an index of deterioration of the insulating paper. According to the Japan Electrical Manufacturers' Association Standard (JEM Standard, issued in 1993), use limit (life) of such insulating paper is about 450 in terms of the average degree of polymerization of cellulose.

Here, a decomposition reaction of cellulose as a main component of the insulating paper will be described briefly. Cellulose is a polymer material having glucose rings linearly polymerized, as illustrated in following chemical formula 1.

[Chemical formula 1]

Chemical formula 1

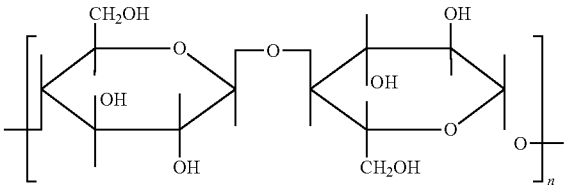

The decomposition reaction of cellulose ($(C_6H_{10}O_5)_n$) is roughly classified into three types, i.e., an oxidation reaction, a hydrolysis reaction, and a pyrolysis reaction. The oxidation reaction is a reaction in which a hydroxyl group (—OH) in cellulose is oxidized into a carbonyl group (—CO—) or a carboxyl group (—COOH) in the presence of oxygen to generate water ($H_2O$), carbon dioxide ($CO_2$), carbon monoxide (CO), and the like. The hydrolysis reaction is a reaction in which an ether bond (—O—) in cellulose is broken in the presence of water to generate carbon dioxide, carbon monoxide, a glucose molecule ($C_6H_{10}O_6$), and the like. The pyrolysis reaction is a reaction in which a chemical bond in cellulose is broken by heat.

The pyrolysis reaction requires a higher temperature than the oxidation reaction and the hydrolysis reaction. Therefore, in a normal environment, the pyrolysis reaction is less likely to occur than the oxidation reaction and the hydrolysis reaction. The hydrolysis reaction breaks a main chain of cellulose. As a result, the hydrolysis reaction directly decreases the average degree of polymerization of cellulose. It is said that the carboxyl group generated in the oxidation reaction performs a catalytic action in the hydrolysis reaction. From these facts, it is said that the hydrolysis reaction of cellulose has a large influence on the time-related deterioration of the insulating paper. In other words, it is considered that durability of the insulating paper is enhanced by suppressing the hydrolysis reaction of cellulose (for example, enhancing water repellency of paper).

A variety of techniques for improving water resistance and heat resistance of cellulose are proposed. Examples thereof include a method for cyanoethylating or acetylating cellulose with acetonitrile. However, hydroxyl groups in cellulose form a hydrogen bond between molecules, and therefore have a low chemical reactivity. As a result, a complicated manufacturing process is necessary for the above-described method, and costs are thereby raised disadvantageously.

Meanwhile, there is a method for improving water resistance and heat resistance of cellulose without need of a chemical reaction with a hydroxyl group in cellulose. For example, JP 2003-082598 A discloses highly water-resistant paper provided with a surface coating film containing a polyol on at least one surface of a paper base material impregnated with an impregnating solution mainly containing polyisocyanate. According to JP 2003-082598 A, a bond having excellent chemical strength such as a urethane bond is generated between polyisocyanate with which the paper base material is impregnated and the surface coating film containing a polyol (between layers of the paper base material and the surface coating film). As a result, highly water-resistant paper having excellent water resistance and heat resistance is obtained.

JP 7-310300 A discloses base paper for a laminated plate. The base paper for a laminated plate includes a paper base material and a mixture containing a synthetic resin having a methylol group and a flame retardant containing methylolated phosphoric acid-dicyandiamide at a weight ratio of 1:0.4 to 2.0. The mixture is included in the base material at a content of 2 to 12% by weight with respect to an absolute dry weight of the base material, and is insolubilized. According to JP 7-310300 A, the synthetic resin and the flame retardant are subjected to a crosslinking reaction. As a result, the mixture containing the flame retardant is firmly fixed in the base paper. Flame-retardant base paper having excellent flame retardance and water resistance is thereby obtained.

JP 2012-219379 A discloses water-repellent printing paper. In the water-repellent printing paper, a support mainly containing pulp fiber is coated or impregnated with surface treating liquid containing at least a water-repellent agent and polymer latex having a hetero-phase structure. According to JP 2012-219379 A, highly water-repellent paper is obtained.

SUMMARY OF THE INVENTION

As described above, it is considered that a life of an oil-immersed transformer largely depends on a life of insulating paper. In general, it is considered that temperature rise of insulating paper with which a winding conductor is directly coated is larger than that of insulating oil while a transformer is driven. Therefore, a driving temperature (allowable temperature) of the oil-immersed transformer largely depends on heat resistance of the insulating paper with which the winding conductor is coated.

Recently, it has been strongly requested to update the oil-immersed transformer. In updating, the oil-immersed transformer is strongly desired to have high efficiency, a large capacity and/or a small size. One solution that satisfies these requests is to downsize the oil-immersed transformer by raising a driving temperature thereof.

Meanwhile, the above-described decomposition reaction of cellulose is a kind of chemical reaction. Therefore, a reaction rate of the decomposition reaction is increased as the temperature rises. That is, in order to satisfy the requests for the oil-immersed transformer, the insulating paper is required to be able to suppress the decomposition reaction of cellulose even when the driving temperature rises (in other words, to have high heat resistance and durability). As described above, the insulating paper is a mat-like material having fine pores, and exhibits an excellent insulating property while the pores are impregnated with electrical insulating oil. Therefore, the insulating paper needs to have a high impregnating ability to make the insulating oil smoothly infiltrate the insulating paper.

Even if the insulating paper is highly functional, the insulating paper is not suitable for an industrial product when the cost is significantly high. It is very important to provide insulating paper produced by a simple process at low cost.

In the highly water-resistant paper described in JE 2003-082598 A, the surface coating film containing a polyol is formed on the surface of the paper base material. As a result, it is expected that an amount of water absorbed from the surface is largely reduced, and a hydrolysis reaction of the paper base material itself is suppressed. However, from description of JP 2003-082598 A, it does not seem that use of the highly water-resistant paper in JP 2003-082598 A as electrical insulating paper is assumed. For example, in an example of JP 2003-082598 A, a coated board having a basis weight of 400 g/m$^2$ is used as the paper base material, and a coating amount of a resin is 34 g/m$^2$. Therefore, when the highly water-resistant paper in JP 2003-082598 A is used as the electrical insulating paper of the oil-immersed transformer, it is supposedly difficult to securely impregnate the interior of the paper base material with the insulating oil because of a large coating amount of a resin.

The flame-retardant base paper described in JP 7-310300 A is also expected to have high flame retardance and water resistance to suppress a hydrolysis reaction of the base paper. However, in the flame-retardant base paper in JP 7-310300 A, the synthetic resin is cured and a crosslinked structure is formed in the paper base material used as the base paper for a laminated plate. As in JP 2003-082598 A, it is considered that the impregnating ability with the insulating oil is largely decreased.

The water-repellent printing paper described in JP 2012-219379 A is also expected to have high water repellency to suppress a hydrolysis reaction of cellulose. However, in the first place, the printing paper in JP 2012-219379 A is not assumed to be used while being immersed in insulating oil. Therefore, when the printing paper in JP 2012-219379 A is used as insulating paper of an oil-immersed transformer, it is considered that a formed water-repellent layer is dissolved in the insulating oil and does not function as the water-repellent layer.

Therefore, an object of the present invention is to provide electrical insulating paper having better durability and heat resistance than those in the related art at low cost while keeping a mechanical property, an electrical insulating property, and an impregnating ability with the insulating oil equivalent to those of the electrical insulating paper in the related art, and suppressing a decomposition reaction of cellulose. Another object of the present invention is to provide a stationary induction electrical apparatus using the electrical insulating paper.

In order to accomplish the above-described objects, an embodiment of the present invention provides electrical insulating paper used while being immersed in electrical insulating oil. The electrical insulating paper includes a paper base material mainly containing cellulose, an adsorption layer formed by adsorption on an entire surface of the paper base material, and a moisture barrier layer formed by being chemically bonded to the adsorption layer. The moisture barrier layer includes an amphipathic molecule containing both a hydrophobic hydrocarbon group and a hydrophilic functional group in one molecule. The amphipathic molecule is chemically bonded to the adsorption layer via the hydrophilic functional group. The hydrophobic hydrocarbon group covers the surface of the paper base material.

In order to accomplish the above-described objects, another embodiment of the present invention provides a stationary induction electrical apparatus. In the stationary induction electrical apparatus, each of an iron core and a conductor winding is insulated by electrical insulating paper and electrical insulating oil in a complex manner. The electrical insulating paper is the above-described electrical insulating paper according to the embodiment of the present invention.

According to an embodiment of the present invention, it is possible to provide electrical insulating paper having better durability and heat resistance than those in the related art at low cost while keeping a mechanical property (e.g. tensile strength), an electrical insulating property, and an impregnating ability with insulating oil equivalent to those of the electrical insulating paper in the related art, and suppressing a decomposition reaction of cellulose. In addition, it is possible to provide an oil-immersed stationary induction electrical apparatus having high efficiency, a large capacity and/or a small size by using the electrical insulating paper.

DESCRIPTION OF THE PREFERRED EMBODIMENTS

As described above, electrical insulating paper according to an embodiment of the present invention is used while being immersed in electrical insulating oil. The electrical insulating paper includes a paper base material mainly containing cellulose, an adsorption layer formed by adsorption on an entire surface of the paper base material, and a moisture barrier layer formed by being chemically bonded to the adsorption layer. The moisture barrier layer includes an amphipathic molecule containing both a hydrophobic hydrocarbon group and a hydrophilic functional group in one molecule. The amphipathic molecule is chemically bonded to the adsorption layer via the hydrophilic functional group. The hydrophobic hydrocarbon group covers the surface of the paper base material.

In the present invention, the following improvement and modification can be made to the above-described electrical insulating paper. (i) The adsorption layer includes at least one of urea, thiourea, hexamethylenetetramine, melamine, dicyandiamide, and polyacrylamide. (ii) The hydrophilic functional group in the amphipathic molecule contains at least one of an aldehyde group, a hydroxyl group, a carboxyl group, and a glycidyl group. (iii) The electrical insulating paper has a water contact angle of 100° or more on a surface thereof, a heat resistance temperature index of +20 K or more based on JEC standard 6151, and a total amount of formation of the adsorption layer and the moisture barrier layer of 5 $mg/m^2$ or less per surface.

Hereinafter, embodiments of the present invention will be described in detail with reference to the drawings. The present invention is not limited to the embodiments described here. Combination and improvement can be appropriately made within a range not departing from the technical idea of the invention.

(Electrical Insulating Paper)

Figure 1:
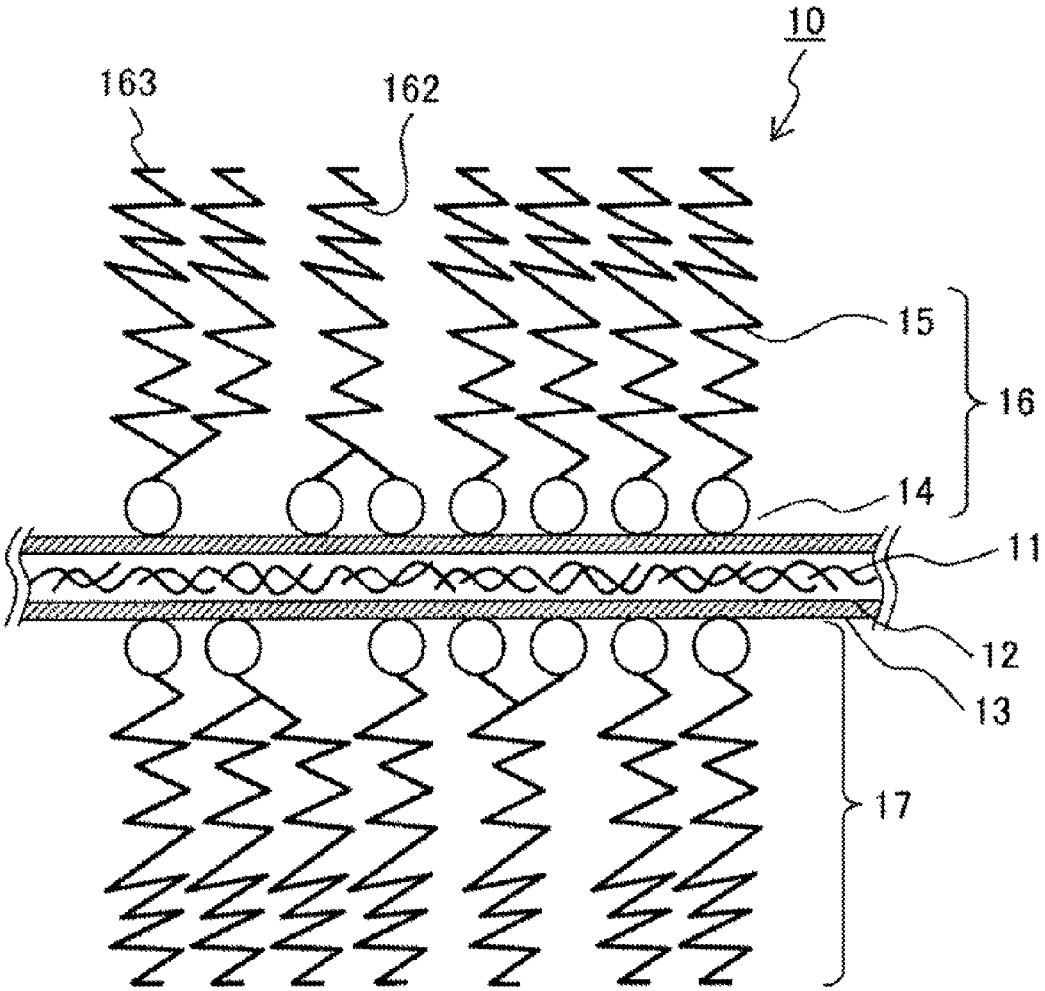
FIG. 1 is a schematic view of a cross section of electrical insulating paper according to an embodiment of the present invention.

FIG. 1 is a schematic view of a cross section of electrical insulating paper according to an embodiment of the present invention. As illustrated in FIG. 1, in electrical insulating paper 10 according to the embodiment of the present invention, an adsorption layer 13 is formed by adsorption on a surface of a paper base material 12 mainly containing cellulose 11, and a moisture barrier layer 17 is formed outside the adsorption layer 13. The entire surface of the paper base material 12 is covered with the adsorption layer 13 and the moisture barrier layer 17. The moisture barrier layer 17 includes an amphipathic molecule 16 containing both a hydrophilic functional group 14 and a hydrophobic hydrocarbon group 15 in one molecule. The hydrophilic functional group 14 is chemically bonded to the adsorption layer 13 to be fixed. The hydrophobic hydrocarbon group 15 is arranged on an outer side. Metaphorically speaking, in a fine structure of the electrical insulating paper 10, it seems that hairs including the amphipathic molecule 16 are growing on the entire surface of the paper base material 12. The amphipathic molecule 16 may be an amphipathic molecule 162 containing a plurality of hydrophilic functional groups 14 in one molecule, or an amphipathic molecule 163 containing a plurality of hydrophobic hydrocarbon groups 15 in one molecule.

In the electrical insulating paper 10 according to the embodiment of the present invention having the above-described structure, even when a slight amount of moisture is mixed in electrical insulating oil in which the electrical insulating paper 10 is immersed, the moisture barrier layer 17 (particularly, the hydrophobic hydrocarbon group 15) blocks moisture from approaching the paper base material 12 to suppress hydrolysis of the cellulose 11.

Meanwhile, the moisture barrier layer 17 exhibits an excellent lipophilic property to oil due to the hydrophobic hydrocarbon group 15 of the amphipathic molecule 16. Oil rapidly passes through the moisture barrier layer 17 to infiltrate between molecules of the cellulose 11 in the paper base material 12. As a result, the electrical insulating paper 10 exhibits an excellent impregnating ability with the insulating oil when being immersed in the electrical insulating oil. As described above, the impregnating ability of the electrical insulating paper with the insulating oil is one of important characteristics from the viewpoints of an electrical insulating property and cooling performance in an oil-immersed transformer.

In FIG. 1, in order to assist understanding of the invention, the amphipathic molecule 16 (particularly, the hydrophobic hydrocarbon group 15) is oriented perpendicularly to the surface of the paper base material 12. However, the present invention is not limited to such a structure, and also includes a case where the hydrophobic hydrocarbon group 15 is inclined relative to (lying on) the surface of the paper base material 12. In FIG. 1, the moisture barrier layer 17 is a monomolecular layer of the amphipathic molecule 16. However, the present invention is not limited to such a structure. The moisture barrier layer 17 may include a plurality of molecular layers of the amphipathic molecules 16, or the amphipathic molecules 16 may be bonded to each other (for example, cross-linked or polymerized) within a range not to block permeability of the electrical insulating oil.

The adsorption layer 13 according to the embodiment of the present invention is preferably formed on the paper base material 12 by chemical adsorption (for example, a hydrogen bond or a dipolar interaction). In the moisture barrier layer 17 according to the embodiment of the present invention, the hydrophilic functional group 14 of the amphipathic molecule 16 is preferably bonded to the adsorption layer 13 firmly by some chemical bond. Examples of the form of the bond include an ester bond (—COO—), an amide bond (—CONH—), an imide bond (—CONHCO—), an imine bond (—C═N—), and a bond formed by an epoxy ring opening reaction (—COHCNH—). By these bonds, the paper base material 12 is bonded to the adsorption layer 13 firmly, and the adsorption layer 13 is also bonded to the moisture barrier layer 17 firmly. As a result, the moisture barrier layer 17 exhibits excellent oil resistance (the moisture barrier layer 17 is not eluted or released from the paper base material 12 even in the electrical insulating oil). On the other hand, for example, when wax or the like generally used for a water-repellent agent is used as the moisture barrier layer, the wax has low oil resistance. Therefore, the wax is eluted or released from the insulating paper in the electrical insulating oil, and a water-repellent effect cannot be kept for a long time.

That is, the electrical insulating paper 10 according to the embodiment of the present invention is characterized in that the electrical insulating paper 10 has an excellent lipophilic property to the electrical insulating oil, oil resistance that prevents elution or release into the electrical insulating oil, and an impregnating ability with the insulating oil to make the electrical insulating oil infiltrate the electrical insulating paper 10 rapidly, in addition to water repellency that prevents moisture from entering the paper base material 12 (details thereof will be described later).

As the adsorption layer 13 formed on the paper base material 12 by adsorption, an amine compound is preferably used. As the amine compound, at least one of urea, thiourea, hexamethylenetetramine, melamine, dicyandiamide, and polyacrylamide can be preferably used. The amine compound is hydrophilic. Therefore, the amine compound has a high affinity for cellulose, and is chemically adsorbed on the paper base material 12 easily. Therefore, once the amine compound is adsorbed, the amine compound can stay on the surface of the paper base material 12 without being easily eluted or released from the paper base material 12.

In addition, when the amine compound encounters a water molecule, the amine compound can chemically react with the water molecule to consume the water molecule. Therefore, even if the amine compound in the adsorption layer 13 remains on the surface of the paper base material 12 without being chemically bonded to the amphipathic molecule 16, when moisture enters the paper base material 12 by going through the moisture barrier layer 17, the adsorption layer 13 suppresses hydrolysis of the cellulose 11 by consuming the moisture.

When the cellulose 11 as a main component of the paper base material 12 is oxidized to be deteriorated, aldehyde is generated. When the aldehyde is further oxidized to be deteriorated, a carboxylic acid is generated. The carboxylic acid thus generated is considered to promote the hydrolysis of the cellulose 11. It is known that the above-described amine compound chemically reacts with an aldehyde compound. The amine compound chemically reacts with an aldehyde group generated by oxidation deterioration of the cellulose 11 to consume the aldehyde group. It is considered that generation of the carboxylic acid can be thereby suppressed and the hydrolysis reaction of the cellulose 11 can be suppressed.

The above-described amine compound has an excellent chemical reactivity with a kind of hydrophilic functional group. Therefore, the amphipathic molecule 16 preferably includes at least one of an aldehyde group (—CHO), a hydroxyl group (—OH), a carboxyl group (—COOH), and a glycidyl group (epoxy group) as the hydrophilic functional group 14. When the amphipathic molecule 16 includes such a hydrophilic functional group 14, the amphipathic molecule 16 is chemically bonded to the amine compound (i.e., the adsorption layer 13) easily.

The hydrophobic hydrocarbon group 15 in the amphipathic molecule 16 is not particularly limited. However, for example, a saturated hydrocarbon group, an unsaturated hydrocarbon group, or an aromatic hydrocarbon group having an average molecular weight of 100 or more and 500 or less is preferably selected.

The paper base material 12 may include an antioxidant. As described above, cellulose is also deteriorated by an oxidation reaction. Therefore, by adding an antioxidant, deterioration of the cellulose 11 can be further suppressed. As the antioxidant, for example, a compound including a phenol group such as 2,6-di-t-butyl-p-cresol (DBPC) can be preferably used.

The paper base material 12 may include a carboxylic acid remover. As the carboxylic acid remover, a compound containing a carbodiimide group (for example, N,N'-dicyclohexylcarbodiimide) can be preferably used. The compound containing a carbodiimide group chemically reacts with a carboxylic acid generated by the oxidation deterioration of the cellulose 11 to consume the carboxylic acid. The hydrolysis of the cellulose 11 can be thereby suppressed.

(Method for Manufacturing Electrical Insulating Paper)

A method for forming the adsorption layer 13 and the moisture barrier layer 17 on the surface of the paper base material 12 is not particularly limited. The entire surface of the paper base material 12 is required at least to be coated with the adsorption layer 13 and the moisture barrier layer 17 as a result. For example, the adsorption layer 13 can be formed as follows. That is, the surface of the paper base material 12 is coated with a solution including a predetermined amine compound by a conventional coating method (dip coating, spray coating, roll coating, or the like), and heated (so-called baked) to obtain the adsorption layer 13. Similarly, the moisture barrier layer 17 can be formed as follows. That is, the surface of the paper base material 12 on which the adsorption layer 13 has been formed by adsorption is coated with a solution including a predetermined hydrocarbon compound by the conventional coating method, and heated (chemically bonded) to obtain the moisture barrier layer 17. That is, the electrical insulating paper having excellent durability and heat resistance can be obtained by a simple method (at low cost).

In order to manufacture a press board, the paper base material 12 on which the adsorption layer 13 and the moisture barrier layer 17 have been formed may be laminated and pressed. Alternatively, the adsorption layer 13 and the moisture barrier layer 17 may be formed on a board manufactured by laminating and pressing.

(Stationary Induction Electrical Apparatus)

Figure 2:
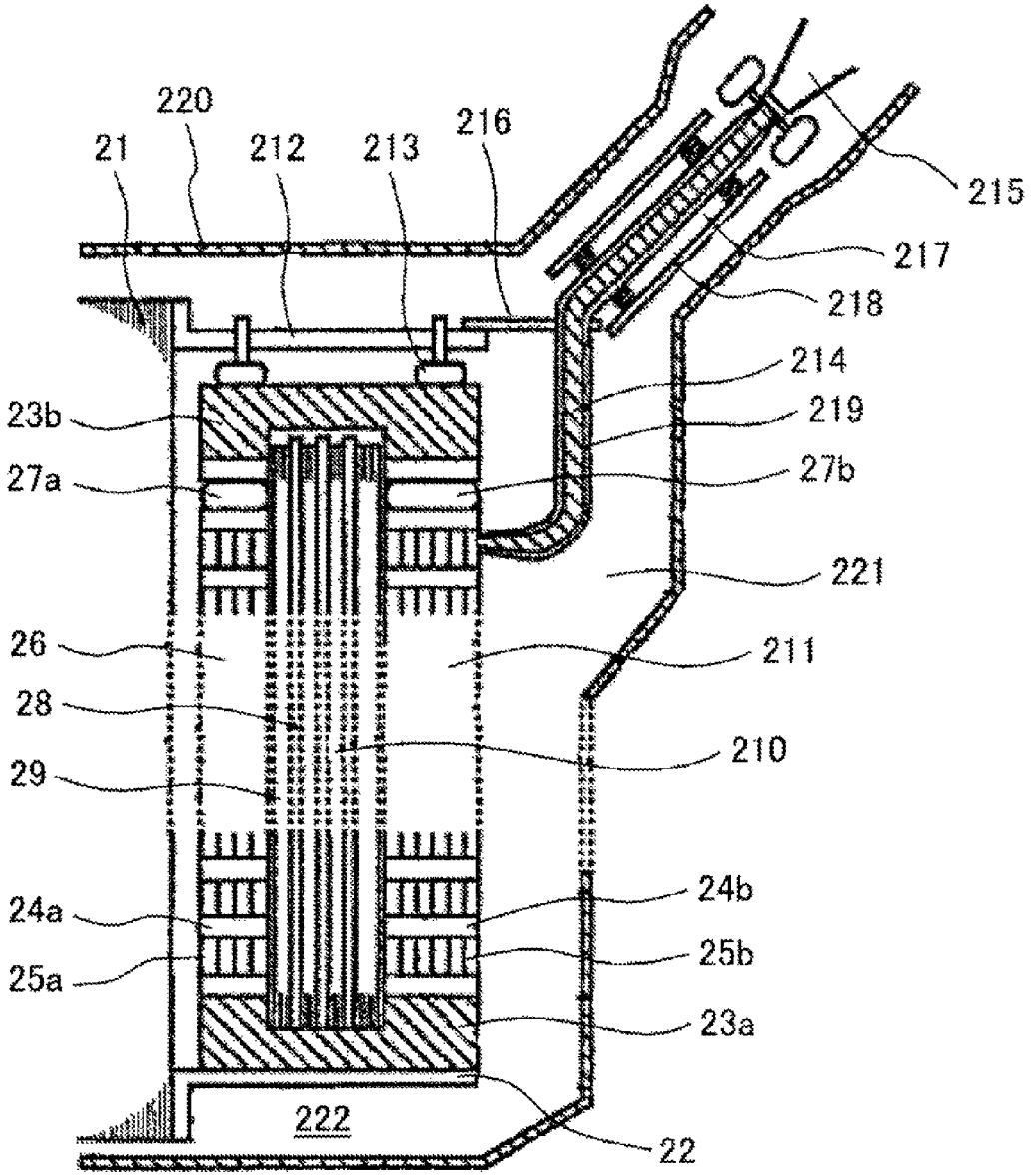
FIG. 2 is a schematic view of a vertical section illustrating an example of an oil-immersed transformer using the electrical insulating paper according to the embodiment of the present invention.

In the present embodiment, as the stationary induction electrical apparatus, an oil-immersed transformer will be described, for example. FIG. 2 is a schematic view of a vertical section illustrating an example of the oil-immersed transformer using the electrical insulating paper according to the embodiment of the present invention. As illustrated in FIG. 2, an insulating support base 23*a* is arranged on a lower support metal fitting 22 attached to a lower part of an iron core 21. A spacer between coils 24*a* and a disc coil 25*a* are alternately stacked on the insulating support base 23*a* to form a low-voltage winding 26. An electrostatic shield 27*a* is arranged on an uppermost part of the low-voltage winding 26. A straight spacer 28 is applied outside the low-voltage winding 26, and the electrical insulating paper is wound outside the straight spacer 28 to form an insulating cylinder 29. Similar straight spacer 28 and insulating cylinder 29 are arranged outside the insulating cylinder 29 to form a main insulating part 210.

An insulating wire is tightened and wound outside the outermost straight spacer 28 of the main insulating part 210 to form a disc coil 25*b*. The disc coil 25*b* and a spacer between coils 24*b* are alternately stacked to form a high-voltage winding 211. An electrostatic shield 27*b* is arranged on an uppermost part of the high-voltage winding 211.

An insulating support base 23*b* is arranged on an upper part of the low-voltage winding 26 and the high-voltage winding 211 thus formed. An upper support metal fitting 212 equipped with a push bolt 213 is arranged on the insulating support base 23*b* to be attached to the iron core 21. A load is applied to the insulating support base 23*b* with the push bolt 213, and the low-voltage winding 26 and the high-voltage winding 211 are tightened to form a winding main body.

A high-voltage lead wire 214 is drawn from an upper end of the high-voltage winding 211 to be connected to a high-voltage bushing 215. At this time, a support arm 216 having a hole into which the high-voltage lead wire 214 is inserted is connected to the upper support metal fitting 212. The high-voltage lead wire 214 is inserted into this hole to support the high-voltage lead wire 214 in the middle. In a part having a small insulating distance between the high-voltage lead wire 214 and a surrounding part thereof, the electrical insulating paper is wound around the high-voltage lead wire 214 via a spacer 217, and a lead wire barrier 218 is arranged thereon. These components are all housed in a transformer main container 220 filled with electrical insulating oil 221 (e.g., mineral oil) to form the oil-immersed transformer.

Figure 3:
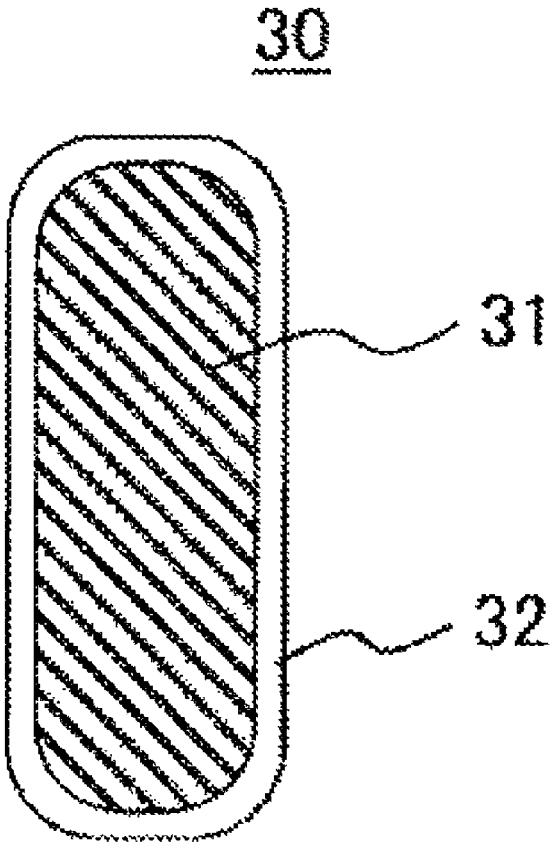
FIG. 3 is a schematic view of a cross section illustrating an example of an insulated wire used in an oil-immersed transformer according to an embodiment of the present invention.

FIG. 3 is a schematic view of a cross section illustrating an example of an insulated wire used in the oil-immersed transformer according to the embodiment of the present invention. An insulated wire 30 includes a conductor 31 and insulating coating 32 with which the surface of the conductor 31 is coated. The insulating coating 32 includes the electrical insulating paper 10 according to the embodiment of the present invent ion.

In the oil-immersed transformer according to the embodiment of the present invention, the electrical insulating paper 10 according to the embodiment of the present invention is used for the spacers between coils 24*a* and 24*b*, the straight spacer 28, and the insulating coating 32. By using the electrical insulating paper having high durability and heat resistance, it is possible to raise a driving temperature of the oil-immersed transformer. As a result, it is possible to provide an oil-immersed stationary induction electrical apparatus having high efficiency, a large capacity and/or a small size.

Examples

Next, the present invention will be described more specifically with reference to Examples and Comparative Examples. The present invention is not limited to these Examples.

(Manufacturing Electrical Insulating Paper in Examples 1 to 20)

Kraft paper was prepared as a paper base material 12. Urea, melamine, dicyandiamide, and polyacrylamide were prepared as an amine compound included in an adsorption layer 13. A long chain hydrocarbon compound containing a carboxyl group, an aldehyde group, a hydroxyl group, or a glycidyl group as a hydrophilic functional group 14 (name of the compound: stearic acid, lauric acid, stearyl aldehyde, stearyl alcohol, or epoxyoctadecane) was prepared as a hydrocarbon compound included in a moisture barrier layer 17. Two kinds of hydrocarbon compounds having different lengths of a hydrophobic hydrocarbon group (different numbers of constituent carbon atoms) were prepared as the hydrocarbon compound containing a carboxyl group as the hydrophilic functional group 14.

In order to form the adsorption layer 13, first, urea, melamine, dicyandiamide, or polyacrylamide as an amine compound was dissolved in a solvent (water or ethanol) to prepare a solution of an amine compound at 1% by mass. Subsequently, the kraft paper was immersed in the solution for five minutes, and then taken out and dried to form the adsorption layers 13 on both surfaces of the kraft paper.

In order to form the moisture barrier layer 17, the above-described long chain hydrocarbon compound was dissolved in a solvent (hexane or toluene) to prepare a solution of the hydrocarbon compound at 1% by mass. Subsequently, the kraft paper on which the adsorption layer 13 had been formed was immersed in the solution for five minutes, and then taken out. The solvent was then dried, and the hydrocarbon compound was attached to both surfaces of the kraft paper. Subsequently, the kraft paper to which the hydrocarbon compound had been attached was heated in a thermostatic bath (maintained at 110° C. for 24 hours) to cause the amine compound of the adsorption layer to be chemically bonded to the long chain hydrocarbon compound. Finally, an excess of the hydrocarbon compound was washed off with the above-described solvent (hexane or toluene) to manufacture electrical insulating paper 10 according to the embodiment of the present invention (Examples 1 to 20). Constitutions of Examples 1 to 20 are illustrated in Table 1 below.

(Manufacturing Electrical Insulating Paper in Comparative Examples 1 to 10)

Kraft paper not subjected to a treatment (kraft paper on which neither the adsorption layer 13 nor the moisture barrier layer 17 had been formed) was used as electrical insulating paper in Comparative Example 1 as a reference. Kraft paper on which only the adsorption layer 13 had been formed (kraft paper on which the adsorption layer 13 had been formed but the moisture barrier layer 17 had not been formed) was used as electrical insulating paper in Comparative Examples 2 to 5. Kraft paper on which only the moisture barrier layer 17 had been formed (kraft paper on which the adsorption layer 13 had not been formed but the moisture barrier layer 17 had been formed) was used as electrical insulating paper in Comparative Examples 6 to 10. Constitutions of Comparative Examples 1 to 10 are also illustrated in Table 1.

(Manufacturing Electrical Insulating Paper in Comparative Examples 11 to 12)

In order to study an influence of an amount of formation of the moisture barrier layer 17 (corresponding to a coating thickness), electrical insulating paper in Comparative Examples 11 to 12 was manufactured. First, the adsorption layers 13 including dicyandiamide were formed on both surfaces of kraft paper by a similar method to that in the above-described Examples.

In order to form the moisture barrier layer 17, a solution of a hydrocarbon compound (epoxyoctadecane) containing a glycidyl group at a concentration of 100% by mass was prepared. The kraft paper on which the adsorption layer 13 had been formed was immersed in the solution for five minutes, and then dried. The hydrocarbon compound was attached to both surfaces of the kraft paper. Subsequently, the kraft paper to which epoxyoctadecane had been attached was heated in a thermostatic bath (maintained at 110° C. for 24 hours) to make a chemical bond between the dicyandiamide and the glycidyl group (here, a polymerization reaction). Electrical insulating paper in Comparative Example 11, having a large amount of formation of the moisture barrier layer 17, was thereby manufactured. In Comparative Example 11, an excess of the hydrocarbon compound (epoxyoctadecane) was not washed off. Meanwhile, an excess of the hydrocarbon compound (epoxyoctadecane) was washed off with hexane from the electrical insulating paper in Comparative Example 11 to thereby manufacture electrical insulating paper in Comparative Example 12.

TABLE 1

Constitutions in Examples 1 to 20 and Comparative Examples 1 to 12

| | Paper base material | Component of adsorption layer | Component of moisture barrier layer: Hydrocarbon compound | Component of moisture barrier layer: Hydrophilic functional group |
|---|---|---|---|---|
| Example 1 | Kraft paper | Urea | Stearic acid | Carboxyl group |
| Example 2 | | | Lauric acid | |
| Example 3 | | | Stearyl aldehyde | Aldehyde group |
| Example 4 | | | Stearyl alcohol | Hydroxyl group |
| Example 5 | | | Epoxyoctadecane | Glycidyl group |
| Example 6 | Kraft paper | Melamine | Stearic acid | Carboxyl group |
| Example 7 | | | Lauric acid | |
| Example 8 | | | Stearyl aldehyde | Aldehyde group |
| Example 9 | | | Stearyl alcohol | Hydroxyl group |
| Example 10 | | | Epoxyoctadecane | Glycidyl group |
| Example 11 | Kraft paper | Dicyandiamide | Stearic acid | Carboxyl group |
| Example 12 | | | Lauric acid | |
| Example 13 | | | Stearyl aldehyde | Aldehyde group |
| Example 14 | | | Stearyl alcohol | Hydroxyl group |
| Example 15 | | | Epoxyoctadecane | Glycidyl group |
| Example 16 | Kraft paper | Polyacrylamide | Stearic acid | Carboxyl group |
| Example 17 | | | Lauric acid | |
| Example 18 | | | Stearyl aldehyde | Aldehyde group |
| Example 19 | | | Stearyl alcohol | Hydroxyl group |
| Example 20 | | | Epoxyoctadecane | Glycidyl group |
| Comparative Example 1 | Kraft paper | — | — | — |
| Comparative Example 2 | | Urea | — | — |
| Comparative Example 3 | | Melamine | | |
| Comparative Example 4 | | Dicyandiamide | | |
| Comparative Example 5 | | Polyacrylamide | | |
| Comparative Example 6 | Kraft paper | — | Stearic acid | Carboxyl group |
| Comparative Example 7 | | | Lauric acid | |
| Comparative Example 8 | | | Stearyl aldehyde | Aldehyde group |
| Comparative Example 9 | | | Stearyl alcohol | Hydroxyl group |
| Comparative Example 10 | | | Epoxyoctadecane | Glycidyl group |
| Comparative Example 11 | Kraft paper | Dicyandiamide | Epoxyoctadecane | Glycidyl group |
| Comparative Example 12 | | | | |

Examination and Evaluation (Studying Amount of Formation of Moisture Barrier Layer)

In the electrical insulating paper manufactured above (Examples 1 to 20 and Comparative Examples 1 to 12), an amount of formation of the moisture barrier layer was studied by two methods described below. One method is as follows. That is, a spectrum was measured in a region of 4000 to 600 $cm^{-1}$ by an attenuated total reflectance method (ATR method) using a Fourier transform infrared spectrophotometer (FT-IR manufactured by PerkinElmer Co., Ltd., Type: Spectrum 100). At first, it was expected that a spectrum deriving from the hydrocarbon compound included in the moisture barrier layer, a spectrum deriving from the amine compound included in the adsorption layer, and a spectrum deriving from cellulose included in the kraft paper would be observed when the moisture barrier layer was sufficiently formed. Results of the observed spectra are illustrated in Tables 2 to 3 below.

The other method is as follows. That is, an increase amount of mass of the electrical insulating paper in Comparative Example 1 (kraft paper not subjected to a treatment) was measured using an electronic balance (manufactured by Sartorius Stedim Japan K.K., Type: R200D). A measurement sample had a size of 20 mm×20 mm. The electronic balance used has a reading limit of 0.01 mg, and displays mass by rounding off the number one digit lower than the reading limit (i.e., the place of 0.001 mg). Results are also illustrated in Tables 2 to 3.

(Evaluation of Impregnating Ability with Insulating Oil)

As an index of an impregnating ability of electrical insulating paper with electrical insulating oil, an infiltrating property of the electrical insulating oil was evaluated. On one surface of the electrical insulating paper in Examples 1 to 20 and Comparative Examples 1 to 12, 5 μL of silicone oil was dropped. The resultant insulating paper was allowed to stand for ten minutes. A spectrum was then measured in a region of 4000 to 600 $cm^{-1}$ by the ATR method of FT-IR for the back surface of the insulating paper. At this time, if a spectrum deriving from the dropped silicone oil can be observed, it can be assumed that the interior of the insulating paper has been impregnated with the silicone oil and the silicone oil has reached the back surface. The insulating paper in which the spectrum deriving from the silicone oil was observed was determined to be "acceptable." The insulating paper in which the spectrum deriving from the silicone oil was not observed was determined to be "not acceptable." Results are also illustrated in Tables 2 to 3.

(Evaluation of Water Repellency)

As an index of water repellency on the surface of the electrical insulating paper, an initial water contact angle on the surface of the insulating paper was measured. The water contact angle was measured by a drop method two seconds after a water drop dropped from a syringe came into contact with the surface of the insulating paper. Results are also illustrated in Tables 2 to 3.

(Evaluation of Tensile Strength)

As an index of a mechanical property of the electrical insulating paper, initial tensile strength was measured. The tensile strength was measured in conformity to JIS standard number C2300. The tensile strength was represented by a value relative to the tensile strength of the electrical insulating paper (kraft paper not subjected to a treatment) in Comparative Example 1 set as 100. Results are also illustrated in Tables 2 to 3.

(Evaluation of Dielectric Breakdown Strength)

As an index of an electric property of the electrical insulating paper, initial alternating current dielectric breakdown strength was measured. The dielectric breakdown strength was measured in conformity to JIS standard number C2300. The alternating current dielectric breakdown strength was represented by a value relative to the alternating current dielectric breakdown strength of the electrical insulating paper (kraft paper not subjected to a treatment) in Comparative Example 1 set as 100. Results are also illustrated in Tables 2 to 3.

(Evaluation of Heat Resistance Temperature Index)

As an index of durability and heat resistance of the electrical insulating paper, a heat resistance temperature index was measured. The heat resistance temperature index was evaluated in conformity to JEC standard number 6151 according to the following procedures.

After insulating paper was dried, first, silicone oil in which nitrogen gas had been bubbled to be saturated, and a water content thereof was 20 ppm or less was prepared as electrical insulating oil. Subsequently, the fully dried electrical insulating paper was immersed in the silicone oil, and putt and sealed in a pressure container. After the electrical insulating paper was heated in the pressure container in a range of 130 to 170° C., the tensile strength of the electrical insulating paper was measured. By using the tensile strength of the electrical insulating paper (kraft paper not subjected to a treatment) in Comparative Example 1, measured in advance, as an initial value, a temperature and time at which the tensile strength was reduced by half were determined. A temperature index after 20,000 hours was then determined. The heat resistance temperature index was represented by a relative value based on the heat resistance temperature index in Comparative Example 1. Results are also illustrated in Tables 2 to 3.

TABLE 2

Results of examination and evaluation in Examples 1 to 20

| | Amount of formation of moisture barrier layer | | Impregnating | Water | | Dielectric | Heat resistance |
|---|---|---|---|---|---|---|---|
| | Spectrum by FT-IR | Increase of mass (mg) | ability with insulating oil | contact angle | Tensile strength | breakdown strength | temperature index (K) |
| Example 1 | Amine | 0.00 | Acceptable | 122° | 101 | 101 | +25 |
| Example 2 | compound | | | 110° | 99 | 99 | +22 |
| Example 3 | Cellulose | | | 115° | 99 | 98 | +23 |
| Example 4 | | | | 116° | 102 | 99 | +23 |
| Example 5 | | | | 120° | 100 | 100 | +26 |
| Example 6 | Amine | 0.00 | Acceptable | 122° | 102 | 99 | +27 |
| Example 7 | compound | | | 110° | 101 | 98 | +24 |
| Example 8 | Cellulose | | | 115° | 99 | 100 | +25 |
| Example 9 | | | | 116° | 99 | 98 | +25 |
| Example 10 | | | | 120° | 100 | 98 | +28 |
| Example 11 | Amine | 0.00 | Acceptable | 122° | 101 | 100 | +29 |
| Example 12 | compound | | | 110° | 100 | 102 | +25 |
| Example 13 | Cellulose | | | 115° | 101 | 101 | +26 |
| Example 14 | | | | 116° | 99 | 98 | +27 |
| Example 15 | | | | 120° | 100 | 100 | +30 |
| Example 16 | Amine | 0.00 | Acceptable | 122° | 98 | 101 | +23 |
| Example 17 | compound | | | 110° | 99 | 102 | +20 |
| Example 18 | Cellulose | | | 115° | 99 | 99 | +20 |
| Example 19 | | | | 116° | 102 | 99 | +21 |
| Example 20 | | | | 120° | 100 | 101 | +24 |

TABLE 3

Results of examination and evaluation in Comparative Examples 1 to 12

| | Amount of formation of moisture barrier layer | | Impregnating | Water | | Dielectric | Heal resistance |
|---|---|---|---|---|---|---|---|
| | Spectrum by FT-IR | Increase of mass (mg) | ability with insulating oil | contact angle | Tensile strength | breakdown strength | temperature index (K) |
| Comparative Example 1 | Cellulose | — | Acceptable | 49° | 100 | 100 | ±0 |
| Comparative Example 2 | Amine compound | 0.00 | Acceptable | 48° | 99 | 101 | +7 |
| Comparative Example 3 | Cellulose | | | 50° | 98 | 99 | +8 |
| Comparative Example 4 | | | | 50° | 99 | 100 | +11 |
| Comparative Example 5 | | | | 48° | 101 | 100 | +5 |
| Comparative Example 6 | Cellulose | 0.00 | Acceptable | 65° | 100 | 101 | +9 |
| Comparative Example 7 | | | | 60° | 102 | 99 | +5 |
| Comparative Example 8 | | | | 62° | 98 | 100 | +6 |
| Comparative Example 9 | | | | 63° | 99 | 99 | +7 |
| Comparative Example 10 | | | | 66° | 102 | 99 | +10 |
| Comparative Example 11 | Hydrocarbon compound | 6.42 | Not acceptable | Not measured | Not measured | Not measured | Not measured |
| Comparative Example 12 | Hydrocarbon compound Amine compound Cellulose | 1.62 | | | | | |

As illustrated in Table 2, in Examples 1 to 20, in the FT-IR measurement, unexpectedly, a peak deriving from an amine compound and a peak deriving from cellulose were observed, but a peak deriving from a hydrocarbon compound was not observed. Also in the measurement of an increase amount of mass, an increase of mass was not observed. As described above, the electronic balance used in the measurement of mass displays 0.01 mg by rounding off the number at the place of 0.001 mg. From these facts, it is considered that the coating films in Examples 1 to 20 had an increase amount of mass of 0.004 mg or less, and that the amount of formation of the moisture barrier layer was less than a detection limit by the ATR method of FT-IR. When 0.004 mg is converted into a coating amount (total amount in both surfaces) per unit area of the insulating paper, 10 $mg/m^2$ is obtained.

As illustrated in Table 3, in Comparative Example 1, only a peak deriving from cellulose was observed. In Comparative Examples 2 to 5, a peak deriving from an amine compound and a peak deriving from cellulose were observed. In Comparative Examples 6 to 10, only a peak deriving from cellulose was observed. In any of Comparative Examples 2 to 10, an increase of mass could not be observed. From these facts, it is considered that the coating films in Comparative Examples 2 to 10 had an increase amount of mass of 0.004 mg or less, and that the amount of formation of the moisture barrier layer in Comparative Examples 6 to 10 was less than the detection limit by the ATR method of FT-IR.

On the other hand, in Comparative Example 11, only a peak deriving from a hydrocarbon compound was observed, and an increase of mass of 6.42 mg was measured. When the increase amount of mass was converted into a coating amount (total amount in both surfaces) per unit area of the insulating paper, 16 g/m was obtained. In the ATR method of FT-IR, it is generally said that a measurable depth is about 1 μm from the surface. From these facts, it is considered that the moisture barrier layer having a thickness of at least 1 μm was formed in Comparative Example 11.

In Comparative Example 12, a peak deriving from a hydrocarbon compound, a peak deriving from an amine compound, and a peak deriving from cellulose were all observed, and an increase of mass of 1.62 mg was measured. When the increase amount of mass was converted into a coating amount (total amount in both surfaces) per unit area of the insulating paper, 4 $g/m^2$ was obtained. From the observed peaks, it is considered that the moisture barrier layer having a thickness of the detection limit by the ATR method of FT-IR or more and less than 1 μm was formed in Comparative Example 12.

In evaluation of the impregnating ability with the insulating oil, in the electrical insulating paper in Examples 1 to 20 and Comparative Examples 1 to 10, a spectrum deriving from silicone oil was observed by the ATR method of FT-IR. The electrical insulating paper in Examples 1 to 20 and Comparative Examples 1 to 10 was determined to be "acceptable." Spectra in Examples 1 to 20 and Comparative Examples 1 to 10 did not have a particular difference from each other. Therefore, it is not considered that there is a difference from each other in the impregnating ability. Meanwhile, in the electrical insulating paper in Comparative Examples 11 and 12, a spectrum deriving from silicone oil was not observed. The electrical insulating paper in Comparative Examples 0.1 and 12 was determined to be "not acceptable." From these results, it is considered that when a moisture barrier layer (hydrocarbon compound coating film) in an amount of at least 4 $g/m^2$ on both surfaces (2 $g/m^2$ or more on one surface) is formed, the impregnating ability with the electrical insulating oil is reduced.

In evaluation of the water repellency, the water contact angle in Comparative Example 1 (kraft paper not subjected to a treatment) was 49°, and the water contact angles in Comparative Examples 2 to 5 were within a range of ±2% (within a range of ±1°) of that in Comparative Example 1. It was confirmed that these water contact angles were almost the same. That is, it can be said that the adsorption layer does not enhance the water repellency by itself.

Meanwhile, the water contact angles in Comparative Examples 6 to 10 were 60° to 66°, which were about 10° to 20° higher than that in Comparative Example 1. These facts indicate the following. That is, formation of the moisture barrier layer suppresses wettability. However, when the moisture barrier layer was formed alone, the water contact angle was still 90° or less, and did not reach such a level as to exhibit the water repellency. When a result of the heat resistance temperature index described later is considered together, it is considered that the above-described result was obtained because a bonding property between the moisture barrier layer and the kraft paper was not sufficient.

Meanwhile, the water contact angles in Examples 1 to 20 were 110° to 122°, which were about 60° to 70° higher than that in Comparative Example 1. An effect of improving the water repellency was clearly confirmed. When a result of the heat resistance temperature index described later is considered together, it is considered that the above-described result was obtained because a bonding property to the kraft paper was improved due to an interaction between the adsorption layer and the moisture barrier layer, and the kraft paper was firmly coated with the moisture barrier layer.

In evaluation of the tensile strength, the tensile strengths in Examples 1 to 20 were within a range of 12% of those in Comparative Examples 1 to 10. It was confirmed that the tensile strengths in Examples 1 to 20 were almost equivalent to those in Comparative Examples 1 to 10. Also in evaluation of the dielectric breakdown strength, the dielectric breakdown strengths in Examples 1 to 20 were within a range of ±2% of those in Comparative Examples 1 to 10. It was confirmed that the dielectric breakdown strengths in Examples 1 to 20 were almost equivalent to those in Comparative Examples 1 to 10.

In evaluation of the heat resistance temperature index, the heat resistance temperature indices in Comparative Examples 2 to 10 were about 5 to 10 K higher than that in Comparative Example 1. In Comparative Examples 2 to 5, the adsorption layer was formed alone. It is considered that an effect of suppressing the hydrolysis of cellulose by the amine compound in the adsorption layer improved heat resistance. Meanwhile, in Comparative Examples 6 to 10, the moisture barrier layer was formed alone. It is considered that a hydrophobic action by the hydrocarbon compound in the moisture barrier layer suppressed the hydrolysis of cellulose to improve heat resistance.

On the other hand, the heat resistance temperature indices in Examples 1 to 20 were about 20 to 30 K higher than that in Comparative Example 1. It is considered that this result was caused by an improved bonding property to the kraft paper due to the interaction between the adsorption layer and the moisture barrier layer, and the suppressed hydrolysis of cellulose due to a synergistic effect of the adsorption layer and the moisture barrier layer.

As described above, it was confirmed that according to the embodiment of the present invention, it is possible to provide electrical insulating paper having a mechanical property, an electrical insulating property, and an impregnating ability with the insulating oil equivalent to those in the related art, and having better durability and heat resistance than those in the related art. In addition, it is possible to provide an oil-immersed stationary induction electrical apparatus having high efficiency, a large capacity and/or a small size by using the electrical insulating paper.

The above-described embodiments have been specifically described to assist in understanding the present invention. The present invention is not limited to a configuration including all the components described above. For example, it is possible to replace a component of an embodiment with a component of another embodiment. It is also possible to add a component of an embodiment to a component of another embodiment. In addition, a component of each embodiment can be deleted or replaced by another component, or another component can be added thereto.

What is claimed is:

1. Electrical insulating paper used while being immersed in electrical insulating oil, the electrical insulating paper comprising:

a paper base material mainly containing cellulose;

an adsorption layer formed on an entire surface of the paper base material by adsorption; and a moisture barrier layer formed by being chemically bonded to the adsorption layer, wherein the moisture barrier layer consists of an amphipathic molecule containing both a hydrophobic hydrocarbon group and a hydrophilic functional group in one molecule, the amphipathic molecule is chemically bonded to the adsorption layer via the hydrophilic functional group, the adsorption layer includes at least one of urea, thiourea, hexamethylenetetramine, melamine, dicyandiamide, and polyacrylamide, the hydrophilic functional group in the amphipathic molecule contains at least one of an aldehyde group, a hydroxyl group, a carboxyl group, and a glycidyl group, and the hydrophobic hydrocarbon group covers the surface of the paper base material.

2. The electrical insulating paper according to claim 1, wherein the electrical insulating paper has a water contact angle of 100° or more on a surface thereof, a heat resistance temperature index of +20 K or more based on JEC standard 6151, and a total amount of formation of the adsorption layer and the moisture barrier layer of 5 $mg/m^2$ or less per surface.

3. The electrical insulating paper according to claim 1, wherein the hydrophobic hydrocarbon group in the amphipathic molecule contains at least one of a saturated hydrocarbon group, an unsaturated hydrocarbon group, or an aromatic hydrocarbon group having an average molecular weight of 100 or more and 500 or less.

4. The electrical insulating paper according to claim 1, wherein the paper base material includes an antioxidant.

5. A stationary induction electrical apparatus in which each of an iron core and a conductor winding is insulated by electrical insulating paper and electrical insulating oil, wherein the electrical insulating paper is the electrical insulating paper according to claim 1.

* * * * *